US010976093B2

(12) United States Patent
Casanova

(10) Patent No.: US 10,976,093 B2
(45) Date of Patent: Apr. 13, 2021

(54) WATER DISPENSER SYSTEM FOR A REFRIGERATOR

(71) Applicant: WHIRLPOOL CORPORATION, Benton Harbor, MI (US)

(72) Inventor: Jessica Patricia Casanova, General Escobedo (MX)

(73) Assignee: Whirlpool Corporation, Benton Harbor, MI (US)

( * ) Notice: Subject to any disclaimer, the term of this patent is extended or adjusted under 35 U.S.C. 154(b) by 190 days.

(21) Appl. No.: 16/224,990

(22) Filed: Dec. 19, 2018

(65) Prior Publication Data

US 2020/0200460 A1 Jun. 25, 2020

(51) Int. Cl.

| | |
|---|---|
| ***F25D 17/02*** | (2006.01) |
| ***F25D 23/12*** | (2006.01) |
| ***F25D 11/02*** | (2006.01) |
| ***F25D 23/02*** | (2006.01) |

(52) U.S. Cl.

CPC ..... *F25D 17/02* (2013.01); *F25D 11/02* (2013.01); *F25D 23/126* (2013.01); *F25C 2400/14* (2013.01); *F25D 23/028* (2013.01); *F25D 2323/122* (2013.01)

(58) Field of Classification Search

CPC .... F25D 17/02; F25D 23/126; F25C 2400/14; B67D 5/62

USPC ..... 62/389

See application file for complete search history.

(56) References Cited

U.S. PATENT DOCUMENTS

| | | | | |
|---|---|---|---|---|
| 6,973,803 | B2 * | 12/2005 | Olive | B67D 1/0009 62/338 |
| 7,603,869 | B2 * | 10/2009 | Kim | F25D 23/02 62/129 |
| 8,011,537 | B2 | 9/2011 | Muthumani et al. | |
| 9,302,897 | B2 | 4/2016 | Dherde | |
| 2009/0126390 | A1 | 5/2009 | Park | |
| 2009/0165494 | A1 | 7/2009 | Muthumani et al. | |
| 2013/0133355 | A1 * | 5/2013 | Park | F25D 23/126 62/340 |

FOREIGN PATENT DOCUMENTS

| | | | |
|---|---|---|---|
| CN | 10476465 | A | 7/2015 |
| KR | 2005087535 | A | 8/2005 |
| KR | 2010055598 | A | 9/2015 |

* cited by examiner

*Primary Examiner* — Ana M Vazquez
(74) *Attorney, Agent, or Firm* — Price Heneveld LLP

(57) ABSTRACT

A refrigerator includes a cabinet structure having an exterior wrapper and a liner operably coupled to one another to define an insulating space therebetween. The cabinet structure includes a refrigerator compartment. A water storage system includes a first portion disposed within the insulating space and a second portion fluidically coupled to the first portion and positioned within the refrigerator compartment. The first portion of the water storage system is exposed to a temperature level of the insulating space, and the second portion of the water storage system is exposed to a temperature level of the refrigerator compartment that is lower than the temperature level of the insulating space to define a thermal gradient therebetween.

19 Claims, 5 Drawing Sheets

WATER DISPENSER SYSTEM FOR A REFRIGERATOR

BACKGROUND

The present device generally relates to a water storage and cooling system, and more specifically, to a refrigerator having a water storage system that is positioned to reduce cooling times.

SUMMARY

In at least one aspect, a refrigerator includes a cabinet structure having an exterior wrapper and a liner operably coupled to one another to define an insulating space therebetween. The cabinet structure includes a refrigerator compartment and a freezer compartment separated by a partition. A water storage system is comprised of a first portion disposed within the insulating space and a second portion fluidically coupled to the first portion and positioned within the refrigerator compartment.

In at least another aspect, a refrigerator includes a cabinet structure having an exterior wrapper and a liner operably coupled to one another to define an insulating space therebetween. The cabinet structure includes a refrigerator compartment. A water storage system is comprised of a first portion disposed within the insulating space and a second portion fluidically coupled to the first portion and positioned within the refrigerator compartment. The first portion of the water storage system is exposed to a temperature level of the insulating space. The second portion of the water storage system is exposed to a temperature level of the refrigerator compartment that is lower than the temperature level of the insulating space.

In at least another aspect, a refrigerator includes a cabinet structure having an insulating space disposed around a refrigerator compartment. A water storage system includes a first portion disposed within the insulating space and a second portion fluidically coupled to the first portion and disposed within the refrigerator compartment. Water stored in the water storage system moves from the first portion of the water storage system to the second portion of the water storage system due to a thermal gradient present between the insulating space and the refrigerator compartment.

These and other features, advantages, and objects of the present device will be further understood and appreciated by those skilled in the art upon studying the following specification, claims, and appended drawings.

DETAILED DESCRIPTION OF EMBODIMENTS

Figure 1:
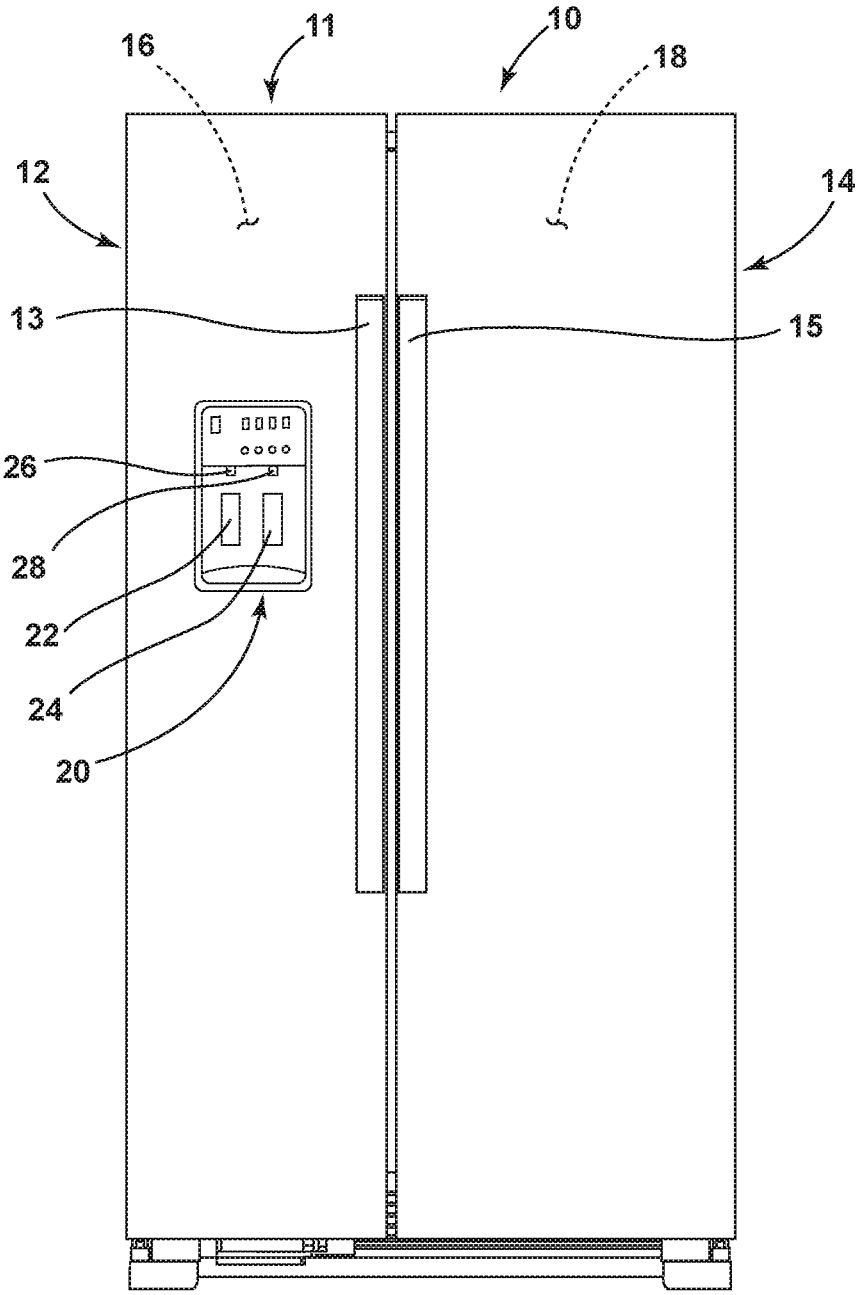
FIG. 1 is a front plan view of a refrigerator.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, reference numeral 10 generally designates an appliance shown in the form of a refrigerator. The refrigerator 10 further includes first and second doors 12, 14 that are disposed in a side-by-side door configuration and are pivotally coupled to a cabinet structure 11, which may include a vacuum insulated cabinet structure. Specifically, the first door 12 is configured to selectively provide access to a freezer compartment 16, while the second door 14 is configured to selectively provide access to a refrigerator compartment 18. The first and second doors 12, 14 illustrated in FIG. 1 include handles 13, 15, respectively, which are configured to allow a user to selectively move the first and second doors 12, 14 between open and closed positions, either separately or together. The first and second doors 12, 14 may also be vacuum insulated structures.

As further shown in FIG. 1, the first door 12 includes a dispensing station 20 which may include one or more paddles 22, 24 which are configured to initiate the dispensing of water and/or ice from outlets, such as outlets 26, 28. In the embodiment shown in FIG. 1, the dispensing station 20 is shown as being accessible from outside of the refrigerator 10 on an exterior portion of the first door 12, but may also be provided along any portion of the refrigerator 10, including an interior of the refrigerator compartment 18, for dispensing ice and/or water.

Figure 2A:
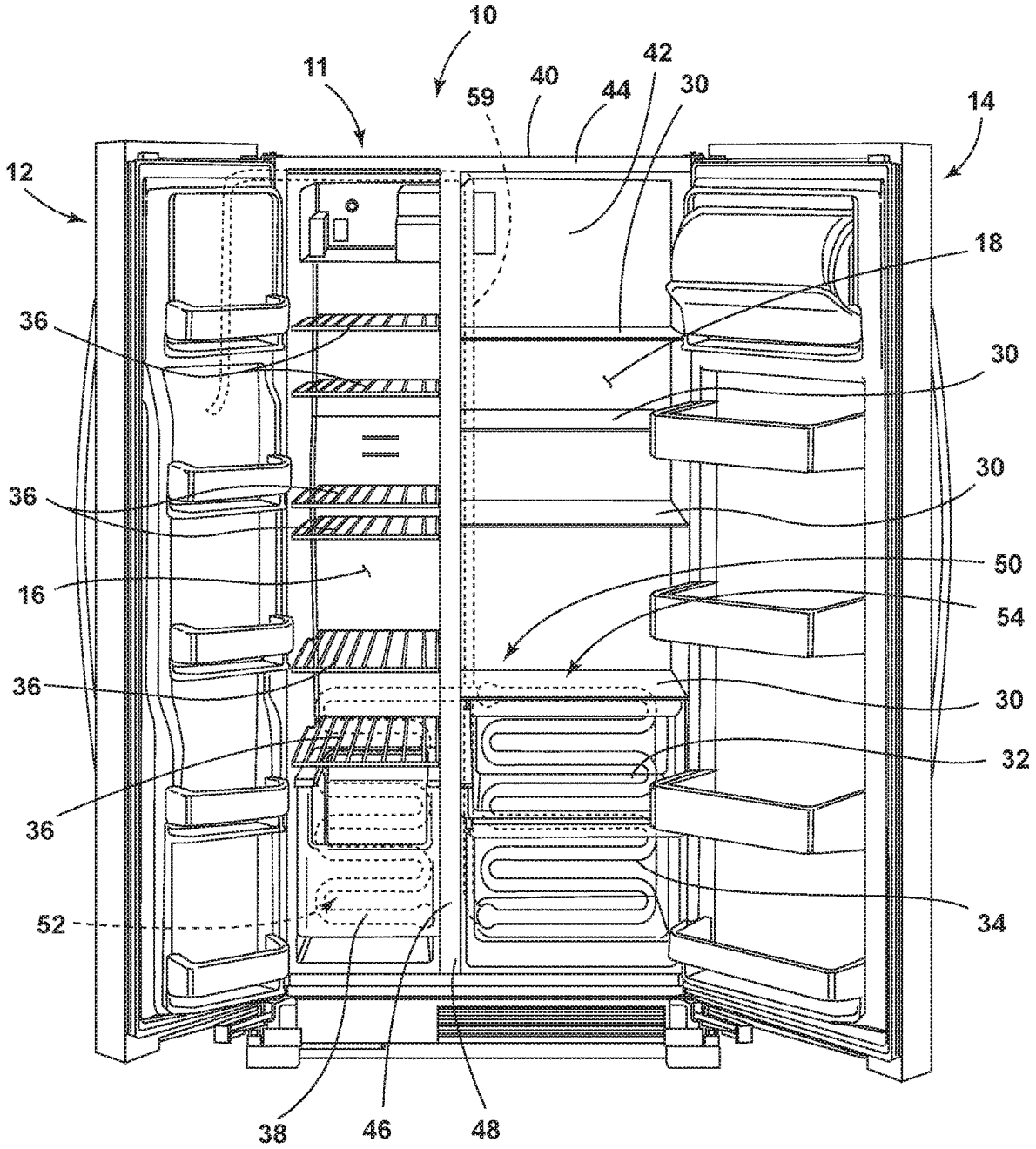
FIG. 2A is a front perspective view of the refrigerator of FIG. 1 having first and second doors shown in an open position.

Referring now to FIG. 2A, the first and second doors 12, 14 are shown in an open position to reveal the interiors of the freezer compartment 16 and of the refrigerator compartment 18, respectively. As shown in FIG. 2, the refrigerated compartment 18 includes a plurality of shelves 30 along with upper and lower drawers 32, 34 for storing refrigerated items. Similarly, the freezer compartment 16 includes a plurality of shelves 36 and a lower bin 38 which may be a slide-out bin for storing items within the freezer compartment 16. In FIG. 2A, the cabinet structure 11 is contemplated to include an exterior wrapper 40 and a liner 42. It is contemplated that the wrapper 40 and liner 42 may be comprised of metal materials, and/or polymeric materials. In FIG. 2A, the first and second doors 12, 14 are configured to seal against a front surface 44 of the cabinet structure 11 when the doors 12, 14 are in the closed position (FIG. 1).

As further shown in FIG. 2A, a partition 46 is disposed between the freezer compartment 16 and the refrigerator compartment 18. The first and second doors 12, 14 are configured to seal against a front surface 48 of the partition 46 as well to fully seal the refrigerator compartment 18 and freezer compartment 16 when the first and second doors 12, 14 are in the closed position (FIG. 1). As further shown in FIG. 2A, a water storage system 50 is shown having a first portion 52 disposed within an insulating space 56 disposed between the exterior wrapper 40 and the liner 42, as best shown in FIG. 3. The water storage system 50 also includes a second portion 54 disposed within the refrigerator compartment 18. The first and second portions 52, 54 of the water storage system 50 are shown in the form of interconnected tubes which define a water storage tank for storing a volume of water to be dispensed through the dispensing station 20. The features of the water storage system 50, and the cooling of the water housed therein, are further described below with reference to FIG. 2B.

Figure 2B:
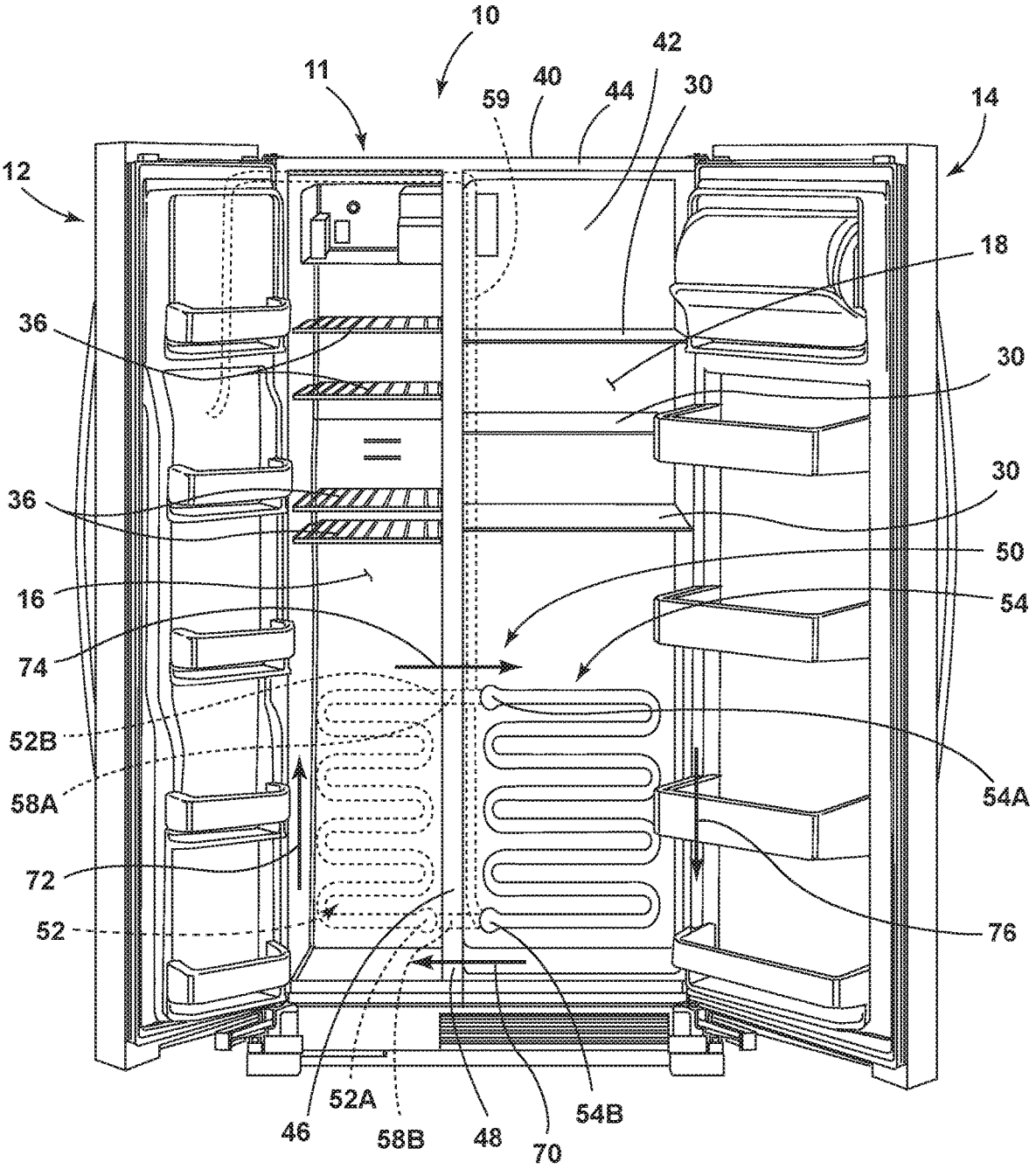
FIG. 2B is a front perspective view of the refrigerator of FIG. 2A with drawers removed from a refrigerator compartment to reveal a water storage system having a first portion disposed in the refrigerator compartment and a second portion shown in phantom in the adjacent to a freezer compartment.
Figure 3:
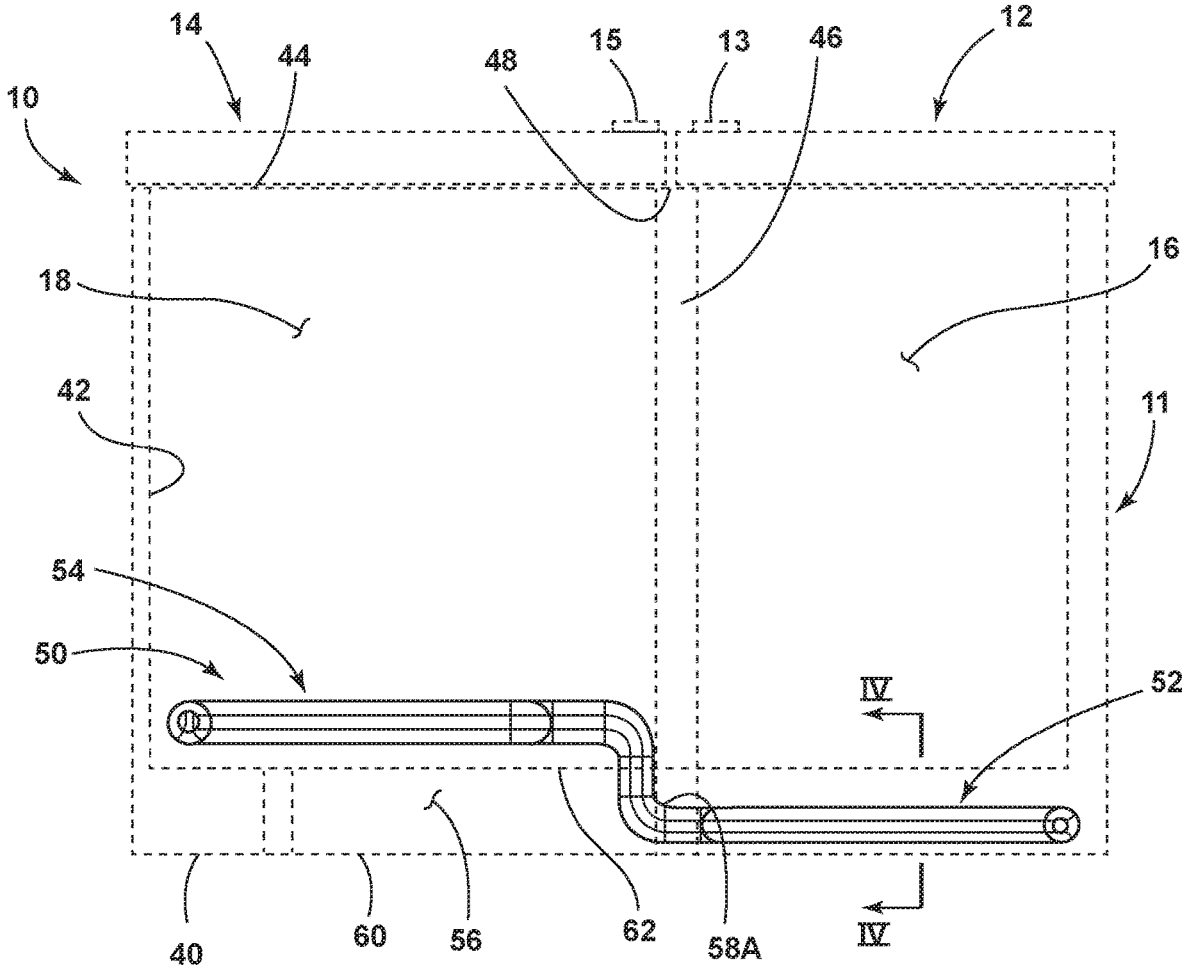
FIG. 3 is a top plan view of the refrigerator of FIG. 1 with a cabinet structure and first and second doors shown in phantom to reveal the water storage system.

Referring now to FIG. 2B, the refrigerator 10 is shown having shelves and bins removed from the cabinet structure 11 to reveal the overall water storage system 50. The water storage system 50 includes one or more fluidically connected tubes which may be polymeric or metal tubes that can hold approximately 2400 ml between both the first and second portions 52, 54 of the water storage system 50. Further, it is contemplated that the first portion 52 of the water storage system 50 and the second portion 54 of the water storage system 50 each have an internal volume of 1000 ml or more, such that they can each hold 1000 ml or more of water at any given time. In this way, is contemplated that the capacity of the water storage system 50 can allow for a large volume of refrigerated water to be dispensed at the dispensing station 20, such as up to 10 glasses of water or more at a temperature of 10° C. or below dispensed from the dispensing station 20 in a single dispensing session. As shown in FIG. 2B, the tubing of the water storage system 50 is disposed in a serpentine pattern to provide for adequate cooling of the water stored therein through the serpentine flow through the various portions of the water storage system 50, as further described below.

As shown in FIG. 2B, the first portion 52 of the water storage system 50 is illustrated in phantom behind the liner 42 of the refrigerator 10. Specifically, the first portion 52 of the water storage system 50 is disposed behind the liner 42 of the refrigerator 10 adjacent to the freezer compartment 16 on a first side of the partition 46. Thus, the first portion 52 of the water storage system 50 is contemplated to be concealed from a user within the insulating space 56 of the cabinet structure 11, as best shown in FIG. 3, behind the freezer compartment 16. The first portion 52 of the water storage system 50 includes a first end 52A and a second end 52B. The first end 52A defines a lower portion of the first portion 52 of the water storage system 50. It is contemplated that an external water supply line for introducing water into the storage system 50 may be connected to the water storage system near the first end 52A of the first portion 52 of the water storage system 50. The second end 52B of the first portion 52 of the water storage system 50 defines an upper portion of the first portion 52 of the water storage system 50. The second end 52B of the first portion 52 of the water storage system 50 is contemplated to be fluidically coupled to an upper bridge 58A that interconnects the first portion 52 of the water storage system 50 and the second portion 54 of the water storage system 50 in a fluidic manner, as best shown in FIG. 3. As housed within the insulating space 56, the first portion 52 of the water storage system 50 is contemplated to be a "warm portion" of the water storage system 50, relatively. As the portion of the liner 42 disposed within the freezer compartment 16 is at about −20° C., and the exterior wrapper 40 may be exposed to ambient temperatures of about 18° C. to about 32° C., the insulating space 56 can vary in temperature. Overall, the temperature in the insulating space 56 is higher than the temperature of the refrigerator compartment 18 where the second portion 54 of the water storage system 50 is disposed, such that a temperature differential exist between the first and second portions 52, 54 of the water storage system 50 along a length of the tubing to define a thermal gradient. Most systems include a water storage system that does not have different temperature zones, so water does not move in these static systems, but is cooled in a single location within such a refrigerator.

With further reference to FIG. 2B, the second portion 54 of the water storage system 50 is contemplated to be fully disposed within the refrigerator compartment 18 on a second side of the partition 46, as compared to the first portion 52 disposed on the opposed first side of the partition 46. The second portion 54 of the water storage system 50 may be visible to a user, or may be concealed by a panel or storage features, such as upper and lower drawers 32, 34 shown in FIG. 2A. The second portion 54 of the water storage system 50 includes a first end 54A and a second end 54B. The first end 54A defines an upper portion of the second portion 54 of the water storage system 50. It is contemplated that the first end 54A of the second portion 54 of the water storage system 50 is coupled to the upper bridge 58A disposed between the first portion 52 and the second portion 54 of the water storage system 50, as best shown in FIG. 3. The second end 54B of the second portion 54 of the water storage system 50 defines a lower portion of the second portion 54 of the water storage system 50. It is contemplated that the second end 54B of the second portion 54 the water storage system 50 is fluidically coupled to a lower bridge 58B that interconnects the second portion 54 of the water storage system 50 with the first portion 52 of the water storage system 50 at the first end 52A of the first portion 52 of the water storage system 50. Thus, the water storage system 50 provides for a continuous loop of fluidically connected pipes having first and second portions 52, 54 coupled at upper and lower ends thereof. As further shown in FIG. 2B, an outlet line 59 is shown operably coupled near the second end 54B of the second portion 54 of the water storage system 50. The outlet line 59 is contemplated to be a flexible piece of tubing that is coupled to the dispensing station 20 (FIG. 1) to deliver cold water to a user. The outlet line 59 may be concealed within the insulating space 56 or otherwise covered by panels within the refrigerator compartment 18. Further, as noted above, the outlet line 59 may direct water to an internal water dispenser disposed within the refrigerator compartment 18. Theoretically, having the outlet line 59 disposed adjacent to the second end 54B of the second portion 54 of the water storage system 50, the coolest water from the water storage system 50 is provided to the dispensing station 20, as further described below.

As housed within the refrigerator compartment 18, the second portion 54 of the water storage system 50 is contemplated to be a "cold portion" of the water storage system 50. It is contemplated that a temperature level within the refrigerator compartment is approximately in a range from about 2° C. to about 4° C., and more likely about 3° C. Overall, the temperature within the refrigerated compartment 18 is contemplated to be above freezing to provide for a fresh food storage compartment that is maintained in a chilled condition. As such, a temperature gradient or thermal gradient exists between the first and second portions 52, 54 of the water storage system 50 given their respective environments and associated temperatures in which they are disposed within the refrigerator 10. The temperature gradient provides for natural convection between the first and second portions 52, 54 of the water storage system 50 for accelerating a time interval for a cooling process of the water stored therein. The natural convection within the water storage system 50 is further described below. It is contemplated that the water storage system 50 may be comprised of a polymeric or metal material that allows for heat transfer, such that water disposed in the first portion 52 of the water storage system 50 is warmed within the insulating space 56 of the refrigerator 10, while water disposed in the second portion 54 of the water storage system 50 is cooled given the exposure of the second portion 54 of the water storage system 50 to the chilled temperatures of the refrigerator compartment 18.

With further reference to FIG. 2B, the natural convection process occurs due to the varying temperatures of the refrigerator compartment 18 and the insulating space 56 to which the water stored in the water storage system 50 is exposed at the second and first portions 54, 52 thereof. This natural convection provides for heat transfer due to the bulk movement of molecules within the water stored within the water storage system 50. The natural convection of the present system cools water stored within the water storage system 50 using sub-mechanisms of advection and diffusion. As used herein, the term "convection" is used to refer to a "free heat convection system," wherein bulk-flow in a fluid is due to temperature-induced differences in buoyancy, as opposed to "forced heat convection" where forces other than buoyancy, such as pump or fan, are used to move the fluid. Natural convection, or free convection, occurs due to temperature differences, such as the temperature differences between the warmer insulating space 56 and the cooled refrigerator compartment 18. These temperature differences realized in the fluidically connected water storage system 50 of the present concept affect the density of the water stored therein, as well as the relative buoyancy of the water. Thus, as shown in FIG. 2B, cooled water from the second portion 54 of the water storage system 50 disposed in the refrigerator compartment 18 can enter into the first portion 52 of the water storage system 50 via the lower bridge 58B in the direction as indicated by arrow 70. Since the first portion 52 of the water storage system 50 is housed in the warmer insulating space 56 of the refrigerator 10, the cooled water introduced thereto will increase in temperature resulting in an overall lower density for the warming water. Having a lower density, the warming water will rise within the first portion 52 of the water storage system 50 in the direction as indicated by arrow 72 from first end 52A to the second end 52B of the first portion 52 of the water storage system 50. The warmed water will then move from the first portion 52 to the second portion 54 of the water storage system 50 via the upper bridge 58A which interconnects the second end 52B of the first portion 52 of the water storage system 50 with the first end 54A of the second portion 54 of the water storage system 50. By entering the second portion 54 the water storage system 50, the warmed water will begin to cool given the exposure to the refrigerated temperatures within the refrigerator compartment 18. As the water cools, the density of the water will rise, such that the heavier cooled water will descend within the second portion 54 of the water storage system 50 in the direction as indicated by arrow 76. As such, water stored in the first portion 52 is less dense than water stored in the second portion 54, such that the water stored in the first portion 52 rises as the water stored in the second portion 54 descends due to a temperature gradient existing between the insulating space 56 and the refrigerator compartment 18. Movement of the water within the water storage system 50 is contemplated to occur at a velocity of about 0.5 mm/s to about 1.0 mm/s providing for heat diffusion (cooling of the water) due to the natural convection caused by the temperature differential within the water storage system 50. The temperature of the moving water may fluctuate between about 4° C. to about 10° C. at any given point within the water storage system 50.

Referring now to FIG. 3, the exterior wrapper 40 includes a rear wall 60 while the liner 42 further includes a rear wall 62. The insulating space 56 is disposed between the exterior wrapper 40 and the liner 42 along all portions of the exterior wrapper 40 and the liner 42, as the liner 42 is received within the exterior wrapper 40. In FIG. 3, the water storage system 50 is shown as having the first portion 52 disposed within the insulating space 56 between the exterior wrapper 40 and the liner 42 at the rear walls 60, 62 thereof, and the second portion 54 disposed within the refrigerated compartment 18. Thus, the water storage system 50 of the present concept provides for first and second portions 52, 54 disposed adjacent to the freezer compartment 16 and within the refrigerator compartment 18, respectively, on opposite sides of the partition 46. With the second portion 54 of the water storage system 50 disposed in the refrigerator compartment 18, water stored therein is exposed to the refrigerated temperatures of the refrigerator compartment 18. As such, the water moving through the second portion 54 of the water storage system 50 is cooled given the exposure to a temperature level of the refrigerator compartment 18 as circulated therein. Water moving through the first portion 52 of the water storage system 50 is disposed adjacent to the freezer compartment 16 within the insulating space 56. In this way, the water stored in the first portion 52 of the water storage system 50 is not exposed to the freezing temperatures of the freezer compartment 16, but rather the warmer temperatures of the insulating space 56 disposed adjacent to the freezer compartment 16 behind the rear wall 62 of the liner 42. As noted above, a temperature level of the insulating space 56 is greater than the temperature level of the refrigerator compartment 18.

Figure 4:
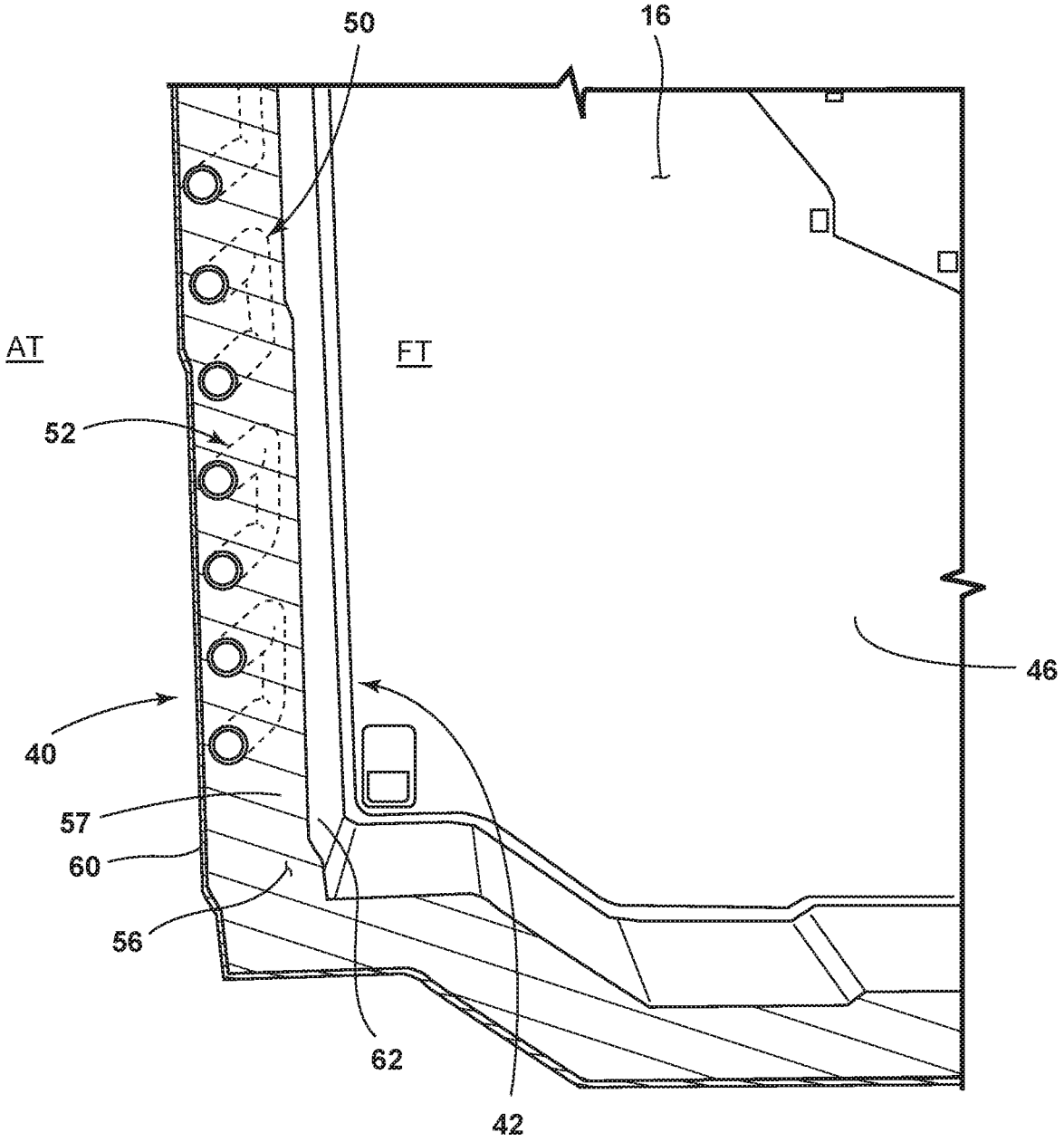
FIG. 4 is a cross-sectional view of the refrigerator of FIG. 3 taken at line IV.

Referring now to FIG. 4, the first portion 52 of the water storage system 50 is shown disposed within the insulating space 56 of the refrigerator 10 between the rear walls 60, 62 of the exterior wrapper 40 and liner 42, respectively. As positioned within the insulating space 56 of the refrigerator 10, the various horizontal passes of the tubing of the first portion 52 of the water storage system 50 are encapsulated within an insulating material 57 which may include a foam insulating material that completely surrounds and encases the first portion 52 of the water storage system 50 within the insulating material 57 of the insulating space 56. As further shown in FIG. 4, as well as FIG. 3, the serpentine piping of the first portion 52 the water storage system 50 is disposed more closely to the rear wall 60 of the exterior wrapper 40 as compared to the rear wall 62 of the liner 42. In this way, the first portion 52 the water storage system 50 is disposed more adjacent to the ambient temperatures AT disposed outside of the refrigerator 10 as compared to the freezing temperatures FT of the freezer compartment 16. In this way, the first portion 52 the water storage system 50 can provide a "warm portion" of the water storage system 50 for increasing the temperature differential between the first portion 52 and the second portion 54 of the water storage system 50.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A refrigerator, comprising:

a cabinet structure having an exterior wrapper, wherein the exterior wrapper includes a rear wall;

a liner operably coupled to the exterior wrapper and having a rear wall, wherein the liner defines a refrigerator compartment and a freezer compartment separated by a partition;

an insulating space defined between the rear wall of the exterior wrapper and the rear wall of the liner; and a water storage system comprising a first portion disposed behind the freezer compartment within the insulating space, and a second portion fluidically coupled to the first portion and positioned within the refrigerator compartment.

2. The refrigerator of claim 1, wherein the first and second portions of the water storage system include one or more connected tubes.

3. The refrigerator of claim 1, wherein first portion of the water storage system is disposed on a first side of the partition, and further wherein the second portion of the water storage system is disposed on a second side of the partition opposite the first side.

4. The refrigerator of claim 1, including:

a dispensing station fluidically coupled to the water storage system.

5. The refrigerator of claim 1, wherein the first portion of the water storage system is encapsulated in an insulating material disposed within the insulating space.

6. The refrigerator of claim 5, wherein the insulating material includes a foam insulating material.

7. A refrigerator, comprising:

a cabinet structure having an exterior wrapper, wherein the exterior wrapper includes a rear wall;

a liner having a rear wall, wherein the liner is operably coupled to the exterior wrapper to define an insulating space between the respective rear walls thereof, wherein the cabinet structure includes a refrigerator compartment; and a water storage system comprising a first portion disposed within the insulating space and a second portion fluidically coupled to the first portion and positioned within the refrigerator compartment, wherein the first portion is exposed to a temperature level of the insulating space, and further wherein the second portion is exposed to a temperature level of the refrigerator compartment that is lower than the temperature level of the insulating space.

8. The refrigerator of claim 7, wherein water stored in the first portion is less dense than water stored in the second portion, such that the water stored in the first portion rises as the water stored in the second portion descends due to a temperature gradient between the insulating space and the refrigerator compartment.

9. The refrigerator of claim 8, wherein an upper portion of the first portion of the water storage system is fluidically coupled to an upper portion of the second portion of the water storage system.

10. The refrigerator of claim 9, wherein the first portion includes an internal volume of 1000 ml or more.

11. The refrigerator of claim 10, wherein the second portion includes an internal volume of 1000 ml or more.

12. The refrigerator of claim 9, wherein a lower portion of the first portion of the water storage system is fluidically coupled to a lower portion of the second portion of the water storage system.

13. The refrigerator of claim 7, wherein the temperature level in the refrigerator compartment is about 2° C. to about 4° C.

14. A refrigerator, comprising:

a cabinet structure having and exterior wrapper, wherein the exterior wrapper includes a rear wall;

a liner having a rear wall, wherein the liner is operably coupled to the exterior wrapper to define an insulating space between the respective rear walls thereof, wherein the cabinet structure includes a refrigerator compartment; and a water storage system comprising a first portion disposed within the insulating space and a second portion fluidically coupled to the first portion and disposed within the refrigerator compartment, wherein water stored in the water storage system moves from the first portion of the water storage system to the second portion of the water storage system due to a thermal gradient present between the insulating space and the refrigerator compartment.

15. The refrigerator of claim 14, wherein a temperature level of the refrigerator compartment includes a temperature range from about 2° C. to about 4° C.

16. The refrigerator of claim 15, wherein a temperature level within the insulating space is higher than the temperature level of the refrigerator compartment.

17. The refrigerator of claim 14, wherein the first portion of the water storage system includes an internal volume that is substantially equal to an internal volume of the second portion of the water storage system.

18. The refrigerator of claim 17, wherein the internal volume of the first portion of the water storage system is 1000 ml or more, and further wherein the internal volume of the second portion of the water storage system is 1000 ml or more.

19. The refrigerator of claim 14, wherein the first portion of the water storage system is surrounded by an insulating material disposed within the insulating space.

* * * * *